US005979357A

United States Patent [19]

Peavey

[11] Patent Number: 5,979,357

[45] Date of Patent: Nov. 9, 1999

[54] EVIDENCE SEALING TAPE WITH FINGERPRINT IDENTIFICATION ZONE

[75] Inventor: Douglas B. Peavey, Leawood, Kans.

[73] Assignee: The Peavey Corporation, Lenexa, Kans.

[21] Appl. No.: 08/897,125

[22] Filed: Jul. 18, 1997

[51] Int. Cl.[6] ..... B41K 1/00

[52] U.S. Cl. ..... 118/31.5; 427/1

[58] Field of Search ..... 118/31.5; 427/1; 428/40.1, 41.8

[56] References Cited

U.S. PATENT DOCUMENTS

| | | | |
|---|---|---|---|
| 3,664,910 | 5/1972 | Hollie | 118/31.5 X |
| 3,709,524 | 1/1973 | Mckee et al. | 118/31.5 X |
| 4,029,012 | 6/1977 | Smith, III et al. | 101/368 |
| 4,631,203 | 12/1986 | Schaefer et al. | 427/145 |
| 4,706,600 | 11/1987 | Mason, Jr. et al. | 118/31.5 |
| 4,784,876 | 11/1988 | Walker, Jr. et al. | 427/150 |
| 4,943,089 | 7/1990 | Reardon | 283/81 |
| 5,143,551 | 9/1992 | Mason, Jr. et al. | 118/31.5 |

OTHER PUBLICATIONS

Zipr–Weld Products Brochure, Mar. 1996.

*Primary Examiner*—James Sells

*Attorney, Agent, or Firm*—Hovey, Williams, Timmons & Collins

[57] ABSTRACT

A verification assembly (10) for the verification of an article (34) so as to prevent tampering and positively identify the article (34) for use in future legal proceedings. The assembly (10) includes a flexible, adhesive substrate (12) having one face (18) thereof provided with an identification portion (22); the portion (22) presents a sufficient area to allow placement thereon of a unique, identifiable image of a print (38) of a person verifying the article (34). Preferably, a first image developing composition is applied to the identification portion 22, and a supply (14) of second image developing composition is provided, with the second composition being complemental with the first composition for image development. In use, the substrate (12) is adhesively applied to the article (34) so as to inhibit tampering. The verifying person then coats a print area (normally a fingerprint area) with the second composition and presses the print area into engagement with the identification portion (22) of the applied substrate (12). This immediately generates a unique, permanent identifying image of the print area on the substrate (12).

11 Claims, 1 Drawing Sheet

EVIDENCE SEALING TAPE WITH FINGERPRINT IDENTIFICATION ZONE

BACKGROUND OF THE INVENTION

1. Field of the Invention

The present invention is broadly concerned with a verification assembly and method which can be used for verifying and/or insuring a chain of custody of an article, e.g., an item of evidence in a legal proceeding. More particularly, the invention pertains to such a verification assembly which includes a flexible substrate having a pressure-sensitive adhesive applied to one face thereof and with the opposed face having an identification portion for receipt of a unique, identifying print area (e.g., a fingerprint) of the user. In one form of the invention, use can be made of an inkpad where the user simply applies ink to the print area which is then recorded on the identification portion of the substrate. In preferred forms, a first image developing composition is applied to the identification portion of the substrate, and a supply of second image developing composition is provided which is complemental with the first composition for image development. In use, a person seeking to verify an item would substantially permanently attach the substrate to the article, coat a print area (usually a fingerprint) with the second composition and press the coated print area into engagement with the substrate identification portion. This generates a permanent print image on the substrate to further strengthen the chain of custody and verification of the article.

2. Description of the Prior Art

Specialized adhesive tapes have been available for a number of years for use in sealing, protecting and verifying all types of packages, containers, boxes, bottles, envelopes, windows and documents. To give but one example, law enforcement officials use these tapes to form a tamper-indicating seal on an evidence package or container so as to assist in proving that the evidence in question remains in tact from the moment it was collected. In many instances, tapes of this type can also provide a chain of custody owing to the fact that the tapes are tamper-indicating and essentially permanently stick to any surface. Attempts to remove the tape result in shredding and peeling thereof at the point of attempted entry. For example, the tapes may be provided with a "zippered" edge design for tamper indication, solvent-sensitive inks which bleed in response to attempted chemical tampering, and also with a writing strip along the bottom for allowing the user to write dates, numbers, and signatures thereon.

In recent years, a number of highly publicized criminal cases have turned upon chain of custody issues and allegations of evidence tampering. As a consequence, there is an increasing need to enhance the verification and chain of custody integrity of existing evidence tapes.

SUMMARY OF THE INVENTION

The present invention overcomes the problems outlined above, and provides a verification assembly for use in verifying an article (as used herein, "verification" refers to resistance to tampering and enhanced chain of custody) such as an item of evidence or a document. Broadly speaking, the assembly of the invention comprises a flexible substrate having a pair of opposed faces, one face bearing a pressure-sensitive adhesive thereon for substantially permanent attachment of the substrate to an article to be verified, with the opposed face presenting an identification portion. In order to permit permanent affixation of a unique, identifying print of a user, a conventional inkpad may be supplied. Alternately, the identification portion of the substrate is coated with a first image developing composition thereon. A supply of a second image developing composition is also part of this assembly wherein the second composition is complemental with the first composition for image development. The identification portion of the substrate presents a sufficient area to allow placement thereon of a unique, identifiable image of a print of a person verifying the article. Usually the person's fingerprint is used in this context, although palm or footprints could also be employed.

Normally, the substrate is in the form of an elongated opaque paper web with a strippable backing sheet covering the pressure-sensitive adhesive. This substrate can be in the form of an elongated web or a discrete label-type substrate. Where two-component image development systems are employed, the first developing composition is advantageously the dried residue of a dispersion applied to the identification portion, the dispersion including from about 1–10% by weight gallic acid and a suitable carrier/solvent such as alcohol. The second complemental composition preferably comprises ferric chloride.

In use, the flexible substrate is adhesively applied to the article to be verified, and the print area of the verifying person is imaged onto the identification portion of the substrate. The latter operation may be conducted before or after application of the substrate to the article, and can either be accomplished via a conventional inkpad or through the described two-component systems. In either case, the user presses the print area onto the identification portion of the substrate to thereby generate a permanent image of the print thereon.

DETAILED DESCRIPTION OF THE PREFERRED EMBODIMENT

Figure 1:
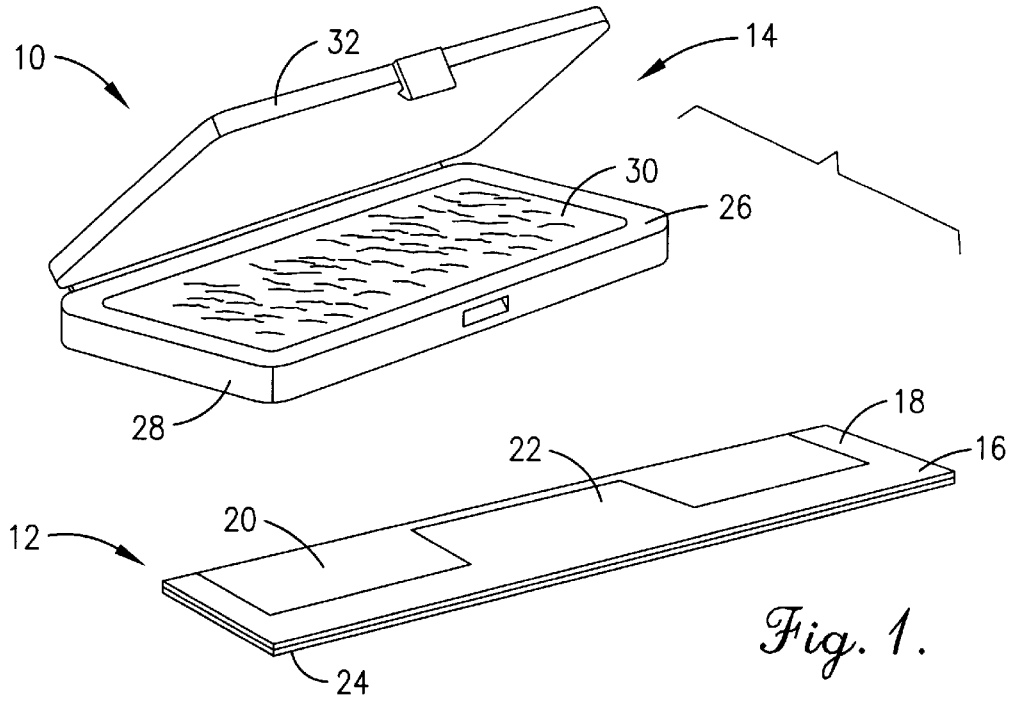
FIG. 1 is a perspective view of a preferred verification assembly in accordance with the invention, made up of a segment of flexible substrate tape and a supply of the second developing composition.
Figure 2:
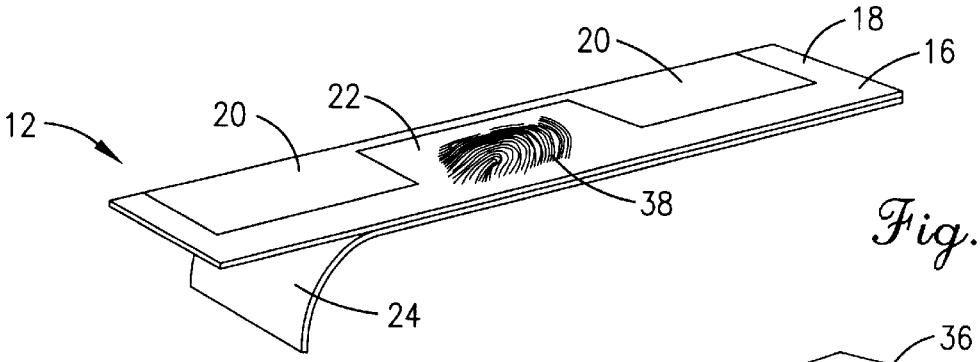
FIG. 2 is a perspective view of the substrate shown in FIG. 1, after application of the verifying person's fingerprint thereon.

Turning now to the drawing, a preferred verification assembly 10 in accordance with the invention broadly includes a flexible substrate 12 as well as a supply 14 of second developing composition.

In more detail, the substrate 12 includes an opaque web 16 of high quality paper stock and having the upper face 18 thereof imprinted with print areas 20 and alternating identification portions 22. The print areas 20 may bear generic statements such as "EVIDENCE" and/or alternately may identify a particular law enforcement agency. The identification portion 22 is coated with a first developing composition which is complemental with the second developing composition for generating a permanent image on the substrate face 16. The most preferred first developing composition is the dry residue of a dispersion made up of about 3 grams of powdered gallic acid dissolved in 1,000 ml of denatured ethyl alcohol. This provides a permanent desirable optically clear coating on the identification portions 22.

A permanent pressure-sensitive adhesive is applied to the opposed second face of substrate 12. Preferably, any one of the known "welding" adhesives are used for this purpose. Such adhesives will tenaciously adhere to virtually any surface, making unauthorized and undetectable removal of the substrate difficult if not impossible. A strippable backing sheet 24 is placed in covering relationship to the adhesive as shown.

The supply 14 is preferably in the form of a portable case 26 having a base 28 supporting an absorbent pad 30 in the nature of an ink pad, together with a hinged lid 32. The second developing composition is applied to the pad 30 and the latter remains moist with the second composition. In preferred forms, the second developing composition is a liquid reagent made up of 1,000 ml of polyethylene glycol, 300 grams ferric chloride hexahydrate and 10 ml of an appropriate surfactant.

It will be understood that the first and second compositions respectively apply to the substrate 12 and within the supply 14 are complemental for generation of permanent images on the substrate 12. That is to say, the first and second compositions chemically react to form a permanent and insoluble image of a print area of the person using the assembly 10. While the described gallic acid/ferric chloride system is preferred, the invention is not so limited. Broadly speaking, essentially any complemental two-component system for permanent image development may be used.

For example, various types of two-component sympathetic ink and developer systems have been described in the past. These include nickel salt/glyoxine systems (U.S. Pat. No. 4,784,876), transition metal salt/oxalic acid systems (U.S. Pat. No. 4,631,203), copper salt/iodide systems (U.S. Pat. No. 3,632,364), and the wide variety of systems disclosed in "Tintas Simpaticas" by P. L. De Araujo Feio, *Revista da Sociedade Brasileira de Quimica,* Boletin Cientificao, Vol. XIV, Janeiro Marco de 1945, N. 1, Rio de Janeiro, Brazil, all of the above being incorporated by reference herein. Such prior two-component image-developing systems can be employed under appropriate circumstances in the invention.

Figure 3:
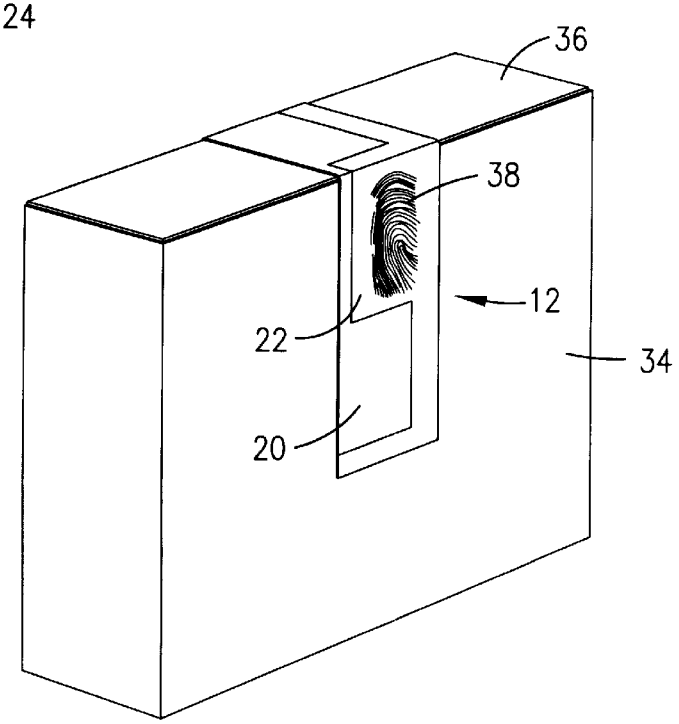
FIG. 3 is a perspective view of an article verified using the assembly of the invention, with the substrate applied to the article for preventing tampering and with the verifying person's print permanently imaged on the substrate identification portion.

The use of assembly 10 in the verification of an article is illustrated in FIG. 3. In this instance, an openable box 34 having a lid 36 is to be verified. The user first obtains a segment of the substrate 12 (which may be provided in roll form from a conventional dispenser) whereupon the backing 24 is removed. The substrate 12 is then applied across lid 36 as shown and extending downwardly along the front and rear panels of the box 34, so that the latter cannot be opened without tampering with the applied substrate segment. The verifying person would then open the case 26 and press a finger or thumbprint area onto pad 30, thereby coating the print area with the liquid second developing composition. Next, the coated print area is directly applied to the identification portion 22 as shown so that the print area is developed as a permanent fingerprint image 38. The verifying person would then sign and date the applied substrate segment, either adjacent or partially over the image 38. This insures that the person signing and dating the substrate is actually the person who placed his or her print on the substrate.

In order to further strengthen the chain of custody of the evidence, the verifying person could, after verifying the box 34 as described, place another piece of the substrate 12 on a property sheet and place his or her print on the identification portion thereof.

While the two-component print image developing systems are preferred, the invention is not so limited. That is, in lieu of providing first and second complemental compositions respectively applied to the identification portion of the substrate and as a supply, the identification portion can be uncoated and an identifying print area can be imaged onto the identification portion via a conventional inkpad. This is done in the normal manner, i.e., pressing a fingerprint or the like onto the inkpad and then imaging the print on the identification portion.

It will thus be seen that the present invention provides an improved verification assembly and method which gives enhanced verification and chain of custody proof as compared with conventional products of this type.

I claim:

1. A verification assembly for the verification of an article, said assembly comprising:

an elongated continuous flexible web substrate having a length greater than its width and presenting a pair of opposed faces, one face having a welding adhesive thereon for substantially permanent attachment of the substrate to said article to be verified, the other face presenting a plurality of separate imprinted regions and a number of separate identification portions along the length of the web; and means for applying a permanent image of a print of a person onto said identification portion, said identification portion presenting a sufficient area to allow placement thereon of a unique, identifiable image of a print of a person verifying the article.

2. The assembly of claim 1, said image-applying means comprising a first image developing composition on said substrate identification portion, and a supply of a second image developing composition, complemental with said first composition for image development, said first and second compositions cooperatively generating a permanent image of said print when said person applies said second composition to the print area and presses the print area into contact with the first composition on said identification portion.

3. The assembly of claim 1, said image-applying means comprising an inkpad.

4. The assembly of claim 1, said substrate comprising an elongated paper web, there being a strippable backing sheet covering said adhesive on one face thereof.

5. The assembly of claim 2, including a portable case carrying said supply of said second developing composition.

6. The assembly of claim 2, said first developing composition comprising the dried residue of a dispersion applied to said identification portion, said dispersion including from about 1–10% by weight gallic acid in alcohol, said second developing composition comprising ferric chloride.

7. The assembly of claim 1, said imprinted regions and identification portions alternating along the length of said web.

8. A substrate for use in verification of an article comprising a roll of elongated continuous flexible web substrate having a pair of opposed faces, one face having a welding adhesive thereon for substantially permanent attachment of the substrate to said article to be verified, the other face presenting a plurality of separate imprinted regions and a number of separate identification portions along the length of the web, said portions each having a first image developing composition thereon, said first composition being complemental with a second image developing composition for image development on said identification portions, said identification portions each presenting a sufficient area to allow placement thereon of a unique, identifiable image of a print of a person verifying the article, said first and second compositions cooperatively generating a permanent image of said print when said person applies said second composition to the print area and presses the print area into contact with the first composition on said identification portion.

9. The substrate of claim 8, said flexible substrate comprising an elongated paper web, there being a strippable backing sheet covering said adhesive on one face thereof.

10. The substrate of claim 8, said first developing composition comprising the dried residue of a dispersion applied to said identification portion, said dispersion including from about 1–10% by weight gallic acid in alcohol, said second developing composition comprising ferric chloride.

11. The substrate of claim 8, said imprinted regions and identification portions alternating along the length of said web.

* * * * *